US006543768B1

(12) United States Patent
Kuzel

(10) Patent No.: US 6,543,768 B1
(45) Date of Patent: Apr. 8, 2003

(54) DICE GAME

(76) Inventor: Martin R. Kuzel, 8413 S. 78th Ave., Bridgeview, IL (US) 60455

( * ) Notice: Subject to any disclaimer, the term of this patent is extended or adjusted under 35 U.S.C. 154(b) by 0 days.

(21) Appl. No.: 10/038,422

(22) Filed: Jan. 7, 2002

(51) Int. Cl.[7] ..... A63F 9/04
(52) U.S. Cl. ..... 273/146; 273/138; 273/274
(58) Field of Search ..... 273/146, 274, 273/138, 268, 142

(56) References Cited

U.S. PATENT DOCUMENTS

| | | | | | |
|---|---|---|---|---|---|
| 164,328 | A | * | 6/1875 | Reiz | 273/146 |
| 1,562,866 | A | * | 11/1925 | Burgess | 273/247 |
| 3,233,343 | A | * | 2/1966 | Short | 434/222 |
| 3,959,893 | A | * | 6/1976 | Sigg | 434/208 |
| 4,421,315 | A | * | 12/1983 | Cutler | 273/268 |
| 4,431,194 | A | * | 2/1984 | Lapadura | 273/248 |
| 4,443,012 | A | * | 4/1984 | Makovic et al. | 273/292 |
| 4,452,588 | A | * | 6/1984 | Smith | 434/207 |
| 4,678,191 | A | | 7/1987 | Mills et al. | |
| 4,743,031 | A | * | 5/1988 | Lamle | 273/146 |
| 4,834,386 | A | * | 5/1989 | Rosenthal et al. | 273/146 |
| 4,893,816 | A | * | 1/1990 | Levy et al. | 273/146 |
| 4,930,780 | A | * | 6/1990 | Goodman et al. | 273/146 |
| 5,050,888 | A | * | 9/1991 | Schultz et al. | 273/248 |
| 5,125,660 | A | * | 6/1992 | Stahl | 273/146 |
| 5,234,218 | A | * | 8/1993 | LaRocca | 273/245 |
| 5,405,145 | A | * | 4/1995 | Jones et al. | 273/146 |
| 5,415,413 | A | * | 5/1995 | Morinich | 273/271 |
| 5,456,467 | A | * | 10/1995 | Hoover | 273/146 |
| 5,605,331 | A | * | 2/1997 | Boe | 273/146 |
| 5,620,183 | A | * | 4/1997 | Skratulia | 273/146 |
| 5,649,704 | A | * | 7/1997 | Dobbin | 273/268 |
| 5,662,330 | A | * | 9/1997 | Spears | 273/274 |
| 6,173,955 | B1 | * | 1/2001 | Perrie et al. | 273/146 |
| 6,305,686 | B1 | * | 10/2001 | Perrie et al. | 273/146 |
| 6,428,005 | B2 | * | 8/2002 | Au-Yeung | 273/274 |
| 6,435,504 | B1 | * | 8/2002 | Nightingale | 273/272 |
| 6,481,713 | B2 | * | 11/2002 | Perrie et al. | 273/146 |

* cited by examiner

*Primary Examiner*—Benjamin H. Layno
*Assistant Examiner*—Dolores R. Collins
(74) *Attorney, Agent, or Firm*—Donald R. Schoonover

(57) ABSTRACT

A chance game uses both luck and skill in a dice controlled game. A player must roll dice having at least a certain die value to begin play and is penalized every time the dice are rolled without that die value until the first time the value is achieved. Thereafter, a turn continues as long as at least one die has the required die value, and dice are removed from each succeeding roll until the specified dice value is no longer achieved. Points are awarded to the player according to a hierarchy of die values. A player achieving a certain number of points can declare an end game which can be blocked by certain other players that achieve minimum values on one last roll during the end game.

11 Claims, 1 Drawing Sheet

DICE GAME

BACKGROUND OF THE INVENTION

1. Field of the Invention

The present invention relates to the general art of chance games, and to the particular field of chance games that use dice.

2. Discussion of the Related Art

While numerous dice throwing games are known, many of these games do not involve strategy. In such instances, luck becomes a dominant factor in winning such a game. While this situation is suitable for some players, many other players want some control over the outcome of the game. Such players will not participate in these games, or will rapidly become bored.

Therefore, there is a need for a dice game where strategy can be used to win a game.

While requiring strategy to win a game may make a dice game more interesting for many players, some players, particularly young and inexperienced players, may not be as adept at strategizing as older and more experienced players and thus will be at a disadvantage with respect to other players in the game. Such players often lose interest or refuse to participate in such games. This leaves them out of any enjoyment associated with the game.

Therefore, there is a need for a dice game in which strategy is required, but the required strategy can be mastered by nearly everyone.

More specifically, there is a need for a dice game in which luck and strategy are balanced whereby anyone can play, yet it will require some skill to ultimately win the game.

PRINCIPAL OBJECTS OF THE INVENTION

It is a main object of the present invention to provide a dice game.

It is another object of the present invention to provide a dice game where strategy can be used during the game.

It is another object of the present invention to provide a dice game in which strategy is required, but the required strategy can be easily mastered by nearly all players.

It is another object of the present invention to provide a dice game in which strategy and luck are balanced.

SUMMARY OF THE INVENTION

These, and other, objects are achieved by a dice game which permits a player to declare himself the winner at selected times after he has accumulated a minimum number of points, and yet every other player has a chance to block the call and cause the game to continue.

In this way, luck is a factor in achieving the minimum number of points required to declare an end game, yet strategy is required in order to know when the opponents cannot block the end game declaration. While there is a certain level of strategy required, such level is not beyond young or inexperienced players. This permits all to participate and enjoy the game.

BRIEF DESCRIPTION OF THE DRAWINGS

The FIGURE represents the items used to play the game embodying the teaching of the present invention.

DETAILED DESCRIPTION OF THE INVENTION

Figure 1:
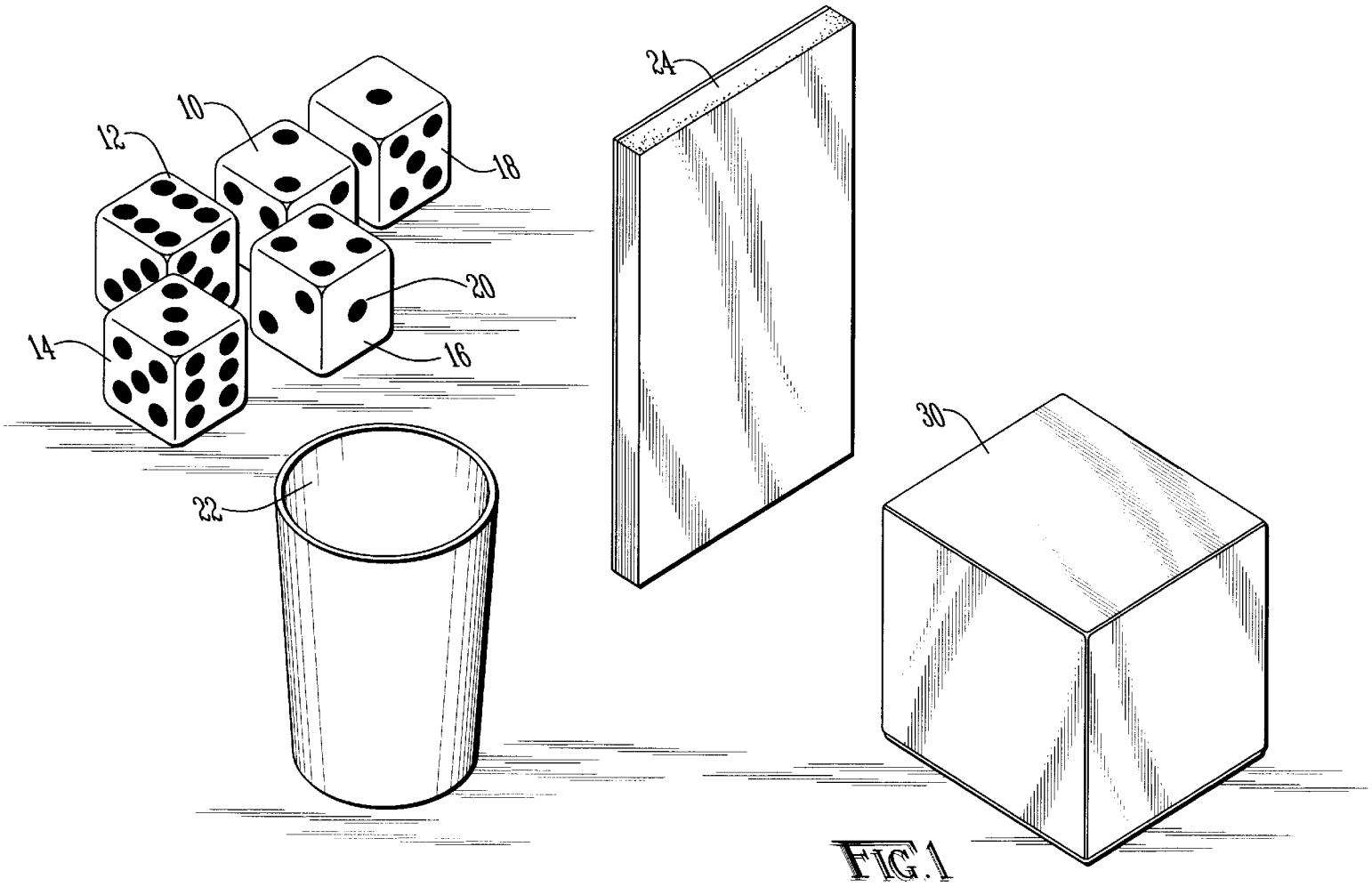

Other objects, features and advantages of the invention will become apparent from a consideration of the following detailed description and the accompanying drawings.

The dice game embodying the present invention requires a player to achieve a specified value (five hundred points or more, as hereinafter described) on rolled dice, as hereinafter explained, in order to get onto the board to begin play, and to subtract points from that player's present total point value (which may cause the total point value to be negative for every time that a "BOGUS" is rolled. Because of this, players actually start the game at different die point values. Once a player achieves a pre-set point total, that player can declare an end game and all other players who are on the board are given one more chance to achieve a selected point total which will block the end game call. The point values can be selected to be high or low depending on the skill level of the players.

A BOGUS can only be attained when all five dice are rolled at the same time. This can occur at any point in the game so long as five dice are rolled at the same time.

Thus, referring to the Figure, the equipment used to play the game embodying the present invention includes five dice 10, 12, 14, 16 and 18, each including the usual markings, such as one or more dots 20, on each side thereof. The equipment further includes a dice cup 22 for tossing the dice and a scorepad 24 for keeping score. The equipment can be stored in a container 30 if desired. A board is not required, so the game can be played anywhere.

More specifically, the method of playing the game embodying the present invention comprises initiating the game by choosing a first player, which can be done by rolling the dice to see who has the highest number, or drawing cards, or simply designating one player to begin play. Once designated, the first player attempts to get "on the board." No player can score any positive points until he has gotten "on the board." A player cannot get on the board until he has rolled the required combination on the dice. Once on the board, the player need not qualify again, and when his turn comes again, any die point value he gets will be added to his total if he voluntarily ends his turn and takes the points. However, before getting on the board, points are taken away from the player every time he rolls the dice and gets a BOGUS regardless of when a BOGUS is rolled. A BOGUS occurs when a player rolls all five dice and fails to roll a "1", "5", three-of-a-kind, four-of-a-kind, or long straight. For rolling a BOGUS, a player is penalized five hundred points even if the player is not yet on the board. The rules for getting on the board will be understood from this discussion and include rolling the dice to have at least one of the dice show a particular point value as determined by the number of dots 20 showing on each die.

Once he rolls five hundred points or more, the player. is on the board and can then accumulate positive points. Once on the board, a player need not get on the board again during the game. Positive points are awarded according to the dots that are turned up on the dice after they have been tossed if the player decides to end his turn and take the points.

The first player continues to roll the dice and is awarded a certain number of points for the other chosen die values achieved during ensuing rolls as long as one of the specified die values is achieved on a previous roll of the dice. The score can be kept on scorepad 24.

After a player begins to roll the dice on his turn, one of the dice having one of the specified die values is removed from the dice that were rolled on the turn before that player rolls again for his next roll on that turn. That is, the first roll is with five dice, the second roll is with four dice or less, the third roll is with three dice or less, the fourth roll is with two dice or less and a fifth roll is with only one dice. However, if more than one die has a specified value, the player can choose to discard one or all of the dice having the specified value. Thus, for example, if the first roll turns up two dice, each of which has a specified die value, that player can choose to take his next roll using four or three dice by removing one or both of the dice having the specified values. Thus, strategy can be used in determining how many dice to roll on the next roll on that turn.

Once a player executes a roll and none of the dice rolled has one of the specified values, that player's turn is over and he must stop rolling the dice.

The total points achieved by the player on that turn are added to any point total existing for that player if he ends his turn and takes the points. The next player then takes his turn to repeat the above-described process. If he chooses, he may elect to not roll since he could lose all of his total point value on that roll.

The above-described process continues until one player achieves a sufficient number of points to equal a preselected number of points, called an end game point value. Once a particular player has achieved or exceeded an end game point value, that particular player is permitted to declare an end game.

Once an end game has been declared by a player who has achieved or exceeds the end game point value, any other player who has achieved a certain number of total points, known as a blocking point value, can challenge the end game.

In one form of the game, all other remaining players are each given one more turn, and executes the above-discussed process of rolling dice, totaling values achieved, continuing to roll dice if a previous roll had at least one die with one of the selected values and removing one or more of the dice having the selected value from each roll for an ensuing roll and totaling up points. If that player reaches a certain total point level which is at least five hundred points or less from the leader, then the end game is declared null and the game continues. If the challenging player fails to achieve the required point total, he is eliminated and the next player takes a turn. This continues until either all of the challenging players have failed to achieve the required blocking point total value, at which time the player initially declaring the end game wins, or at least one of the challenging players achieves the required blocking point total, at which time the game continues between all the players. In one form of the game, if a player has not challenged, but at least one other player achieves the required point total, then the players that remain, including the non-challenging player, continue to play.

Another form of the game will include allowing only players having certain point totals to participate in the end game.

Strategy can be executed by determining when to call an end game, and how to play the dice during the end game process.

The game can be modified to penalize a player declaring an end game and not achieving the end of the game, or by awarding points to any player who successfully blocks an end game strategy. This will add further strategy to the game. Still further, the level of points needed to get "on the board," to declare an end game, or to block an end game can be selected according to the skill level of the players so players of all skill levels can be included in the game.

An example of the values that are required to either get on the board or to continue a turn include designated values of the dice. For example, if any of the dice rolled contains a one, a five, a three-of-a-kind, a four-of-a kind, or a long straight, then the player must continue to roll the dice to achieve five hundred points to get on the board. If, on the other hand, the initial roll does not turn up a die containing either a one or a five, or a three-of-a-kind, a long straight, or a four-of-a-kind, then the player is penalized five hundred points (BOGUS), and his turn ends. This process continues until the player finally rolls the dice and at least one of the dice contains either a one or a five. The dice with the one or the five is removed, and the player rolls again. The player always has his choice of removing the dice containing a one or a five. Thus, if one dice contains a one, and another dice contains a five, the player must remove one of the dice, but has the choice of removing both for his next roll. This continues until none of the dice rolled contains a one or a five. At that time, his turn ends. After each successful roll, that is a roll that turns up one of the dice with a one or a five, the player receives points that are determined according to a hierarchy of points. The point total is cumulative.

If the player does not roll a one, a five, or any point values on his first attempt to get on the board, he is penalized and any penalty points will be charged against the points achieved after he does successfully get on the board. Eventually, the player should achieve a positive accumulated point total.

An example of the points that are used in the game include: all ones equal 100 points each, all fives equal fifty points each. If, on a single roll of the dice, a player rolls a particular combination of dice, he is entitled to certain point values as follows:

| | |
|---|---|
| straight (1-2-3-4-5) | 1000 points |
| straight (2-3-4-5-6) | 1000 points |
| three-of-a-kind: | |
| (1-1-1) | 1000 points |
| (2-2-2) | 200 points |
| (3-3-3) | 300 points |
| (4-4-4) | 400 points |
| (5-5-5) | 500 points |
| (6-6-6) | 600 points |
| four-of-a-kind: | |
| (1-1-1-1) | 1100 points |
| (2-2-2-2) | 1000 points |
| (3-3-3-3) | 1000 points |
| (4-4-4-4) | 1000 points |
| (5-5-5-5) | 1000 points |
| (6-6-6-6) | 1000 points |

If a player takes two rolls in his attempt to get on the board but does not get on the board, he does not suffer the 500-point penalty and simply ends his turn with zero points.

One form of the game penalizes a player whenever he rolls the dice and at least one of the dice does not achieve the selected values. That is, in this example, any time a player rolls the dice and at least one of the rolled dice does not have either a one or a five, then points, such as 500 points, are subtracted from that player's point total. This adds further strategy to which dice a player removes for each turn. In some games, a player can simply pass the dice after taking several passes so he does not take a chance of rolling dice and not having any of the dice show the selected values such as a one or a five.

Another form of the game permits a player who rolls a straight to start his turn over again with the full complement, in this case five, of dice. Another form of the game permits all players one last roll after a particular player declares an end game. If any of the players achieves a point total that is within a certain value of the particular player's point total, the game continues with all players participating. If none of the player's achieves this blocking point total, the game is over.

A game can be played to 10,000 points if desired. Once a player achieves a total point value of 10,000 points or more, he can declare an end game. At that time, any player within 500 points of the declaring player's point total can challenge. If there is a challenge in one form of the game, each of the remaining players gets a turn. If any player equals or exceeds the declaring player's point total after that player's last turn, then the game continues. Any player who does not equal or exceed the declaring player's point total is eliminated. The game continues until all but a declaring player are eliminated.

It is understood that while certain forms of the present invention have been illustrated and described herein, it is not to be limited to the specific forms or arrangements of parts described and shown.

I claim:

1. A method of playing a game comprising:

a) providing five dice;

b) initiating the game by choosing a first player;

c) the first player attempting to get on the board by rolling the dice;

d) the first player continuing to roll the dice until one specified die value of a plurality of specified die values is achieved on at least one of the dice;

e) the first player losing a specific number of points every time the dice are rolled before one of the specified die values is achieved;

f) once one of the specified die values is achieved, considering the first player as being on the board;

g) once one of the specified die values is achieved, awarding the first player a certain number of points for other chosen die values achieved if the specified die value is also achieved on at least one of the dice rolled;

h) once one of the specified die values is achieved, permitting the first player to take another roll of the dice and awarding the first player the certain number of points for the other chosen die values achieved if at least one of the dice rolled on the turn has one of the specified die values;

i) once one of the specified die values is achieved, removing one or more of the dice which have the specified die value thereon, from the dice that were rolled, to be rolled on the next roll;

j) stopping the first player from rolling the dice again if one of the dice rolled does not achieve one of the specified die values; and k) totaling the number of points associated with the first player.

2. The method as described in claim 1 further including a step of permitting a next player to attempt to get on the board after the first player has completed his turn.

3. The method as described in claim 2 further including a step of defining an end game point value and permitting a particular player to declare an end game once the particular player has achieved a point total that is equal to or greater than the end game point value.

4. The method as described in claim 3 further including a step of defining a blocking point value and if one of the players on the board has a point total equal to or greater than the blocking point value, permitting all other players who are on the board to challenge the player declaring an end game.

5. The method as described in claim 4 further including a step of permitting each of the challenging players one more turn.

6. The method as described in claim 5 further including a step of continuing the game after the particular player has declared an end game if any challenging player achieves a predetermined point total on the last turn.

7. The method as described in claim 6 wherein the predetermined point value is a value based on a range of the point total of the particular player declaring the end game.

8. The method as described in claim 7 further including a step of eliminating any challenging player who does not achieve a total point value after his last turn that equals or exceeds the point total of the particular player or is within a preset range of the point total of the particular player declaring an end game and defining players who achieve a point total that is within the preset range or exceeds the point total of the particular player as successful.

9. The method as described in claim 8 further including a step of continuing the game between any successful players and the particular player.

10. The method as described in claim 8 further including a step of continuing the game including any players who have not challenged the particular player but who have not been eliminated.

11. The method as described in claim 10 further including a step of permitting a player who is on the board to take a turn whether or not that player again rolls the specified die value.

* * * * *